US008647153B2

(12) United States Patent
Ju et al.

(10) Patent No.: US 8,647,153 B2
(45) Date of Patent: Feb. 11, 2014

(54) SHIELDED CONNECTOR

(75) Inventors: Ted Ju, Keelung (TW); Ming Jui Tsai, Keelung (TW); You Hua Cai, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 65 days.

(21) Appl. No.: 13/311,481

(22) Filed: Dec. 5, 2011

(65) Prior Publication Data

US 2013/0095698 A1 Apr. 18, 2013

(30) Foreign Application Priority Data

Oct. 12, 2011 (CN) ..... 2011 2 0386296 U

(51) Int. Cl.
*H01R 24/00* (2011.01)

(52) U.S. Cl.
USPC ..... 439/626

(58) Field of Classification Search
USPC ..... 439/626, 70–71, 862, 630, 816, 884
See application file for complete search history.

(56) References Cited

U.S. PATENT DOCUMENTS 7,074,048 B2 * 7/2006 Liao et al. ..... 439/66
7,241,157 B2 * 7/2007 Zhuang et al. ..... 439/188
7,291,021 B2 * 11/2007 Shirai et al. ..... 439/71
7,322,829 B2 * 1/2008 Ma ..... 439/66
7,435,100 B2 * 10/2008 Chang et al. ..... 439/66
7,922,548 B2 * 4/2011 Fan ..... 439/862
8,118,603 B2 * 2/2012 Ho ..... 439/70
2007/0298657 A1 * 12/2007 Ju ..... 439/607
2009/0130906 A1 * 5/2009 Tsao et al. ..... 439/626
2011/0223781 A1 * 9/2011 Ho ..... 439/70
2011/0318966 A1 * 12/2011 Huo et al. ..... 439/626

* cited by examiner

*Primary Examiner* — Jean F Duverne

(74) *Attorney, Agent, or Firm* — Morris, Manning & Martin, LLP; Tim Tingkang Xia, Esq.

(57) ABSTRACT

A shielded connector includes a conductive body having a plurality of receiving holes formed through, a plurality of insulating members respectively fixed in the receiving holes, and a plurality of terminals respectively fixed to the insulating members. Each terminal has a contact portion exposed upward to the insulating member and a soldering portion exposed downward to the insulating member. The terminal and the conductive body are in an nonconductive state. The conductive body is formed by integral injection molding, which does not require pre-molding an insulating body having a plurality of receiving holes and plating metal layers in the receiving holes, so that the process is simple yet novel and the problem that metal layers easily peel off is solved while ensuring a stable and good shielding effect.

15 Claims, 8 Drawing Sheets

SHIELDED CONNECTOR

CROSS-REFERENCE TO RELATED APPLICATIONS

This non-provisional application claims priority under 35 U.S.C. §119(a) on Patent Application No. 201120386296.7 filed in P.R. China on Oct. 12, 2011, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to a shielded connector, and more particularly to a shielded connector capable of reducing electromagnetic interference among terminals.

BACKGROUND OF THE INVENTION

A conventional electrical connector includes a body having a plurality of receiving holes formed through the body, and a plurality of terminals respectively fixed in the receiving holes. The body is made of an insulating material.

Electromagnetic interference occurs among the terminals of the electrical connector during signal transmission. Especially with the development of digital products towards being thin, light and high-end, the volume of the electrical connector decreases accordingly, but increasingly more functions are demanded. Hence, as the volume of the body becomes smaller, and the number of terminals needs to remain unchanged or even be increased, it inevitably reduces the pitch between the terminals, and makes the electromagnetic interference problem worse.

Accordingly, another type of electrical connector has been proposed in this field, in which based on the above electrical connector, a metal layer is plated in each receiving hole, and then an insulating layer is plated on the metal layer. As metals can reflect, absorb and counteract electromagnetic waves, the metal layer may solve the problem of electromagnetic interference among terminals. The insulating layer is located between the terminal and the metal layer, and can prevent conduction between the two. Although the above electrical connector can prevent electromagnetic interference in some cases, the following problems still exist.

1. After the electrical connector is used for a long period of time, the metal layer and the insulating layer are easily aged, or if the metal layer and the insulating layer are plated poorly, the metal layer and the insulating layer are easily broken or even peel off. Once the metal layer and the insulating layer peel off, the electrical connector will lose the electromagnetic shielding function, or even may be damaged due to short circuit.

2. It is rather difficult to plate the metal layer in the narrow receiving hole. Generally, a liquid metal is enabled to flow from above the receiving hole into the receiving hole. In this case, as for the metal layer on the inner wall of the receiving hole, the upper part is thicker than the lower part, resulting in uneven thickness. To reduce the waste of metal materials, the electromagnetic shielding effect at the thin part of the metal layer is poor.

If the metal layer is brush-plated in the receiving hole, a brush needs to be inserted into the receiving hole for plating, but even thickness still cannot be ensured. Therefore, the problem that the electromagnetic shielding effect at the thin part of the metal layer is poor still exists.

3. To enable the electrical connector to achieve a shielding function, it is required to fabricate the body having the receiving holes in advance, plate the metal layer in the receiving hole, and then plate the insulating layer outside the metal layer. The process is complex.

Therefore, a heretofore unaddressed need exists in the art to address the aforementioned deficiencies and inadequacies.

SUMMARY OF THE INVENTION

In one aspect, the present invention is directed to a shielded connector, and more particularly to a shielded connector capable of stably preventing signal interference.

In one embodiment, a shielded connector according to the present invention includes: a conductive body, having a plurality of receiving holes formed through the conductive body; a plurality of insulating members, respectively fixed in the receiving holes; and a plurality of terminals, respectively fixed to the insulating members. Each terminal having a contact portion exposed upward to the insulating member and a soldering portion exposed downward to the insulating member. The terminal and the conductive body are in nonconductive state.

Further, the conductive body is made of a metal material. Alternatively, the conductive body is made of a plastic material added with metal powders or a conductive material. In another embodiment, an insulating layer is disposed on an inner wall surface of the receiving hole. The terminal has a base located in the insulating member. An extending arm extends upward from the base and is exposed upward to the insulating member. The contact portion extends from an end of the extending arm. A connecting portion extends downward from the base and is exposed downward to the insulating member. The connecting portion connects the base and the soldering portion. Insulating layers are plated on surfaces of the extending arm and the connecting portion. The terminal and the insulating member are formed by insert molding. Each soldering portion includes a baffle and a clamping arm respectively extending from two sides of the baffle. The baffle and the clamping arms jointly define a clamping space. A plurality of solder balls are further disposed, and each solder ball is fixed in each clamping space. Alternatively, a plurality of solder balls are further disposed, and each solder ball is fixed to each soldering portion. The solder balls and the conductive body are in nonconductive state. The insulating member is fixed to the conductive body by interference fit. A plurality of supporting blocks are disposed on a top surface of the conductive body. The conductive body has at least one elastic first conductive unit at least partially exposed upward to a top surface of the conductive body, and the conductive body has at least one second conductive unit at least partially exposed downward to a bottom surface of the conductive body. The first conductive unit and the second conductive unit are made of a conductive sponge. The first conductive unit, the conductive body and the second conductive unit are jointly used for transmitting ground signal. At least two neighboring terminals among the terminals form a pair for transmitting differential signal. A plurality of first conductive units and a plurality of second conductive units are distributed around the pair of terminals for transmitting differential signal.

As compared with the related, among other things, the conductive body of the shielded connector of one embodiment of the present invention is formed by integral injection molding, which, unlike the related art, does not require premolding an insulating body having a plurality of receiving holes and plating metal layers in the receiving holes, so that the process is simple and the problem in the related art that metal layers easily peel off is solved while ensuring a stable and good shielding effect.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
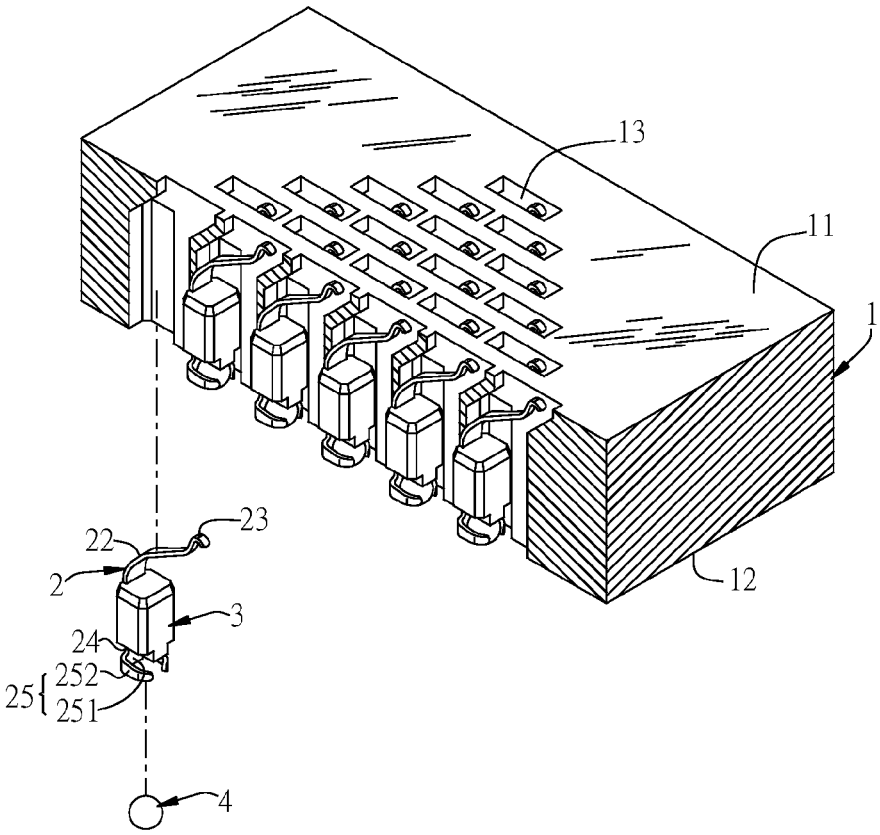
FIG. 1 is a partial exploded cross-sectional view of a shielded connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 2:
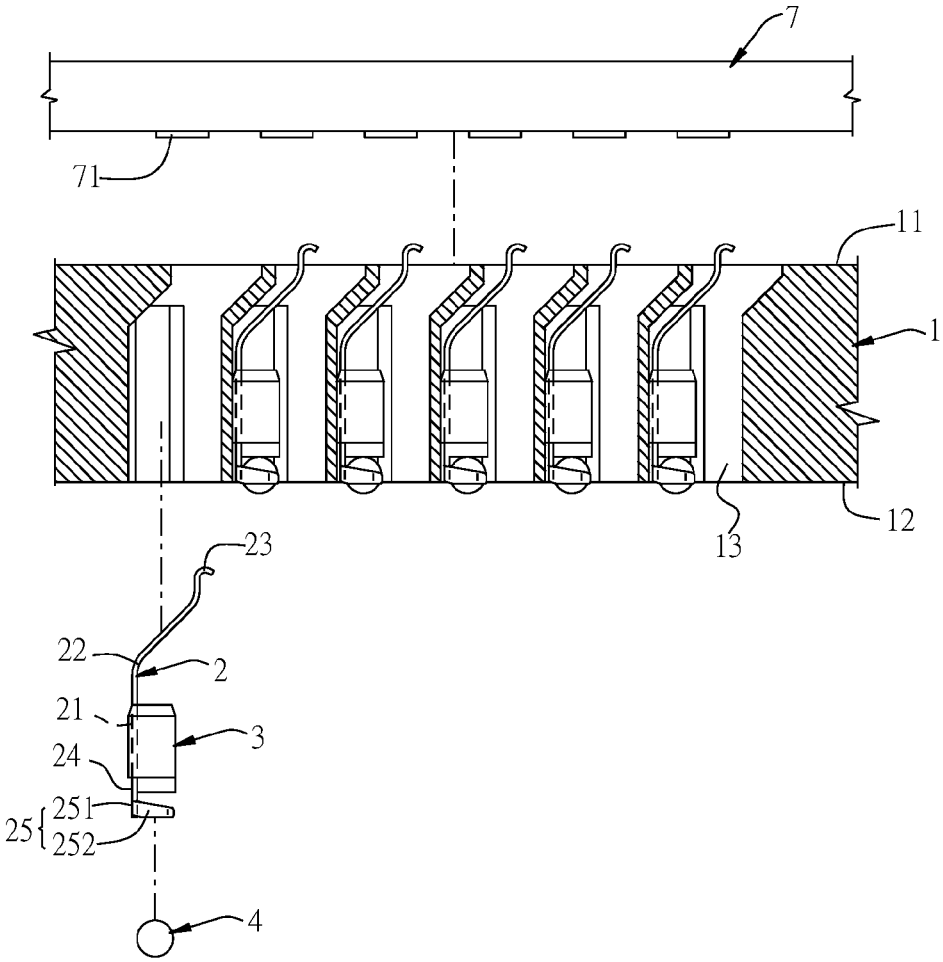
FIG. 2 is a partial exploded cross-sectional view of a shielded connector according to one embodiment of the present invention and a chip module.

Referring to FIG. 1 and FIG. 2, in one embodiment, the shielded connector according to the present invention includes a conductive body 1. A plurality of terminals 2 are located in the conductive body 1. The terminals 2 are respectively fixed in a plurality of insulating members 3. The insulating members 3 are fixed in the conductive body 1. The terminals 2 and the conductive body 1 are in nonconductive state, where the nonconductive state represents no electrical contact between the terminal 2 and the conductive body 1. A plurality of solder balls 4 respectively contact the terminals 2. The solder balls 4 and the conductive body 1 are in nonconductive state, where the nonconductive state represents no electrical contact between the solder balls 4 and the conductive body 1.

Figure 6:
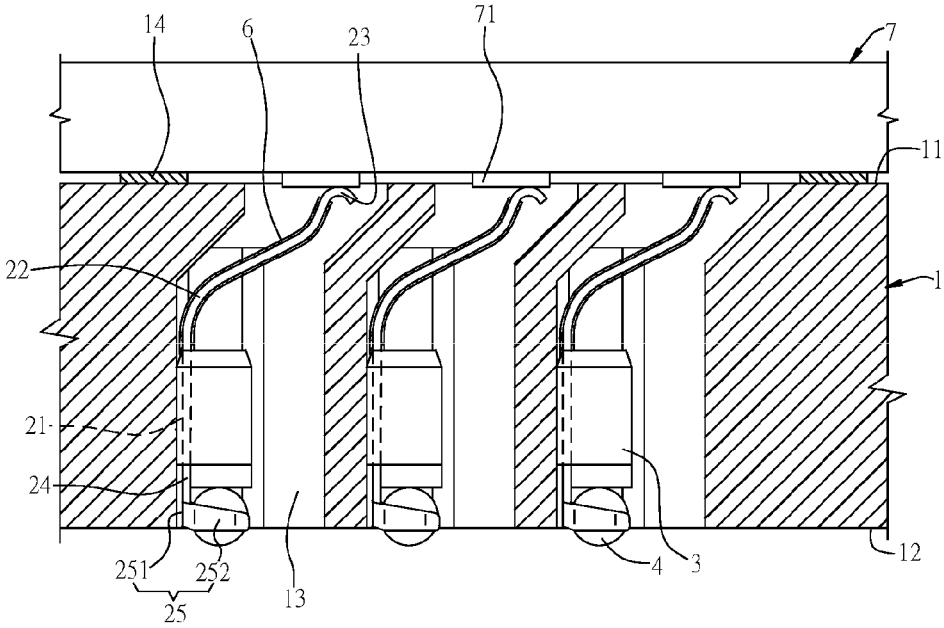
FIG. 6 is an assembled cross-sectional view of a shielded connector according to one embodiment of the present invention where supporting blocks is disposed on a top surface of a conductive body.

The raw material of the conductive body 1 is a mixture of a plastic material and metal powders. The metal powders may also be other conductive materials. Accordingly, the conductive body 1 is formed by integral injection molding. In other embodiments, the raw material may purely be a metal material. The conductive body 1 has a top surface 11 and a bottom surface 12. A plurality of receiving holes 13 is formed through the top surface 11 and the bottom surface 12. Referring to FIG. 6, a plurality of supporting blocks 14 protrudes from the top surface 11, and the supporting blocks 14 are located at peripheral positions of the top surface 11. In other embodiments, the supporting blocks 14 may be located at central positions of the top surface 11, or the supporting blocks 14 are disposed at both peripheral positions and central positions of the top surface 11. The supporting blocks 14 are insulative.

Figure 7:
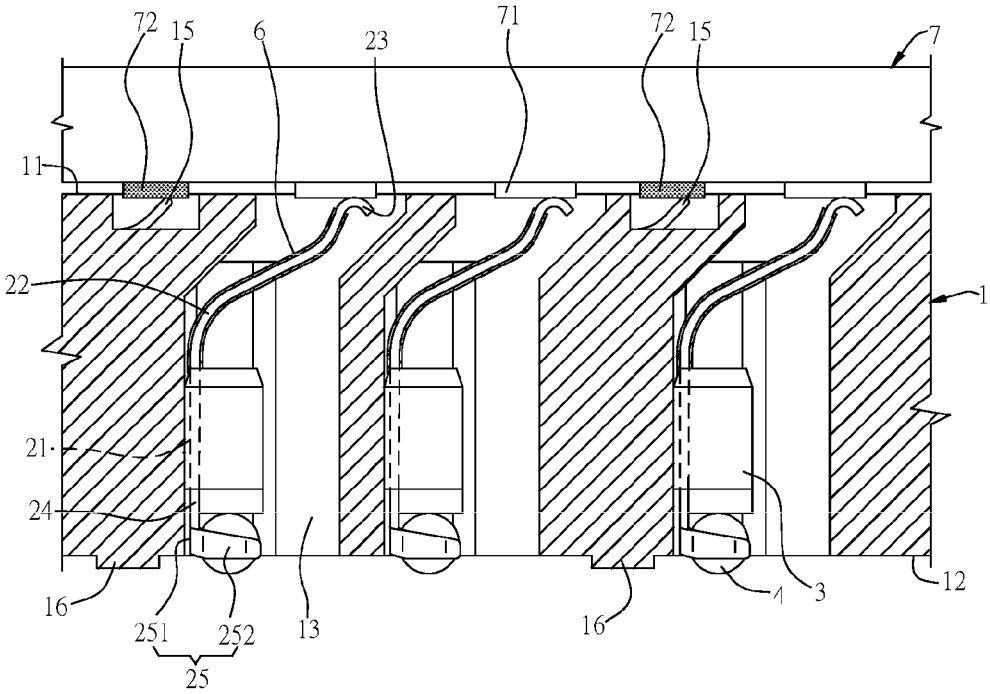
FIG. 7 is an assembled cross-sectional view of a shielded connector according to one embodiment of the present invention where first conductive units and second conductive units are disposed.

Referring to FIG. 7, a plurality of holes are recessed from the top surface 11 of the conductive body 1, and a plurality of first conductive units 15 are respectively fixed in the holes and partially exposed upward to the top surface 11. In other embodiments, a plurality of elastic first conductive units 15 may be disposed from the top surface 11, alternatively, the number of the first conductive unit 15 is one. A plurality of second conductive units 16 are disposed from the bottom surface 12 of the conductive body 1, and the second conductive units 16 are at least partially exposed downward to the bottom surface 12. In other embodiments, the number of the second conductive unit 16 may be one, and a part of the second conductive unit 16 is fixed in the conductive body 1, and the other part is exposed downward to the bottom surface 12.

The first conductive unit 15 and the second conductive unit 16 may be made of an elastic conductive material such as a conductive sponge or a solder material, but the present invention is not limited thereto. The first conductive unit 15, the second conductive unit 16 and the conductive body 1 are electrically conducted with one another.

Figure 3:
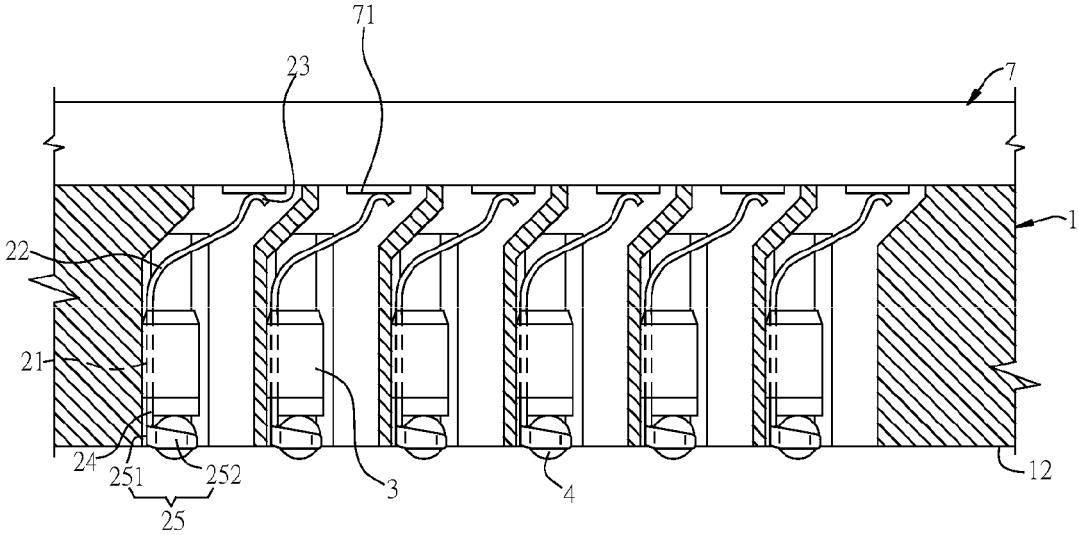
FIG. 3 is an assembled view of FIG. 2.

Referring to FIG. 3, the terminals 2 are respectively located in the receiving holes 13. Each of the terminal 2 has a base 21 located in the insulating member 3, an extending arm 22 extending upward from the base 21 and exposed upward to the insulating member 3, a contact portion 23 extending from an end of the extending arm 22 and exposed upward to the top surface 11 of the conductive body 1, a connecting portion 24 extending downward from the base 21 and exposed downward to the insulating member 3, and a soldering portion 25 extending downward from the connecting portion 24. The connecting portion 24 connects the base 21 and the soldering portion 25. The soldering portion 25 includes a baffle 251 and a clamping arm 252 respectively extending from two sides of the baffle 251. The baffle 251 and the two clamping arms 252 jointly define a clamping space, and the solder ball 4 is fixed in the clamping space.

Figure 8:
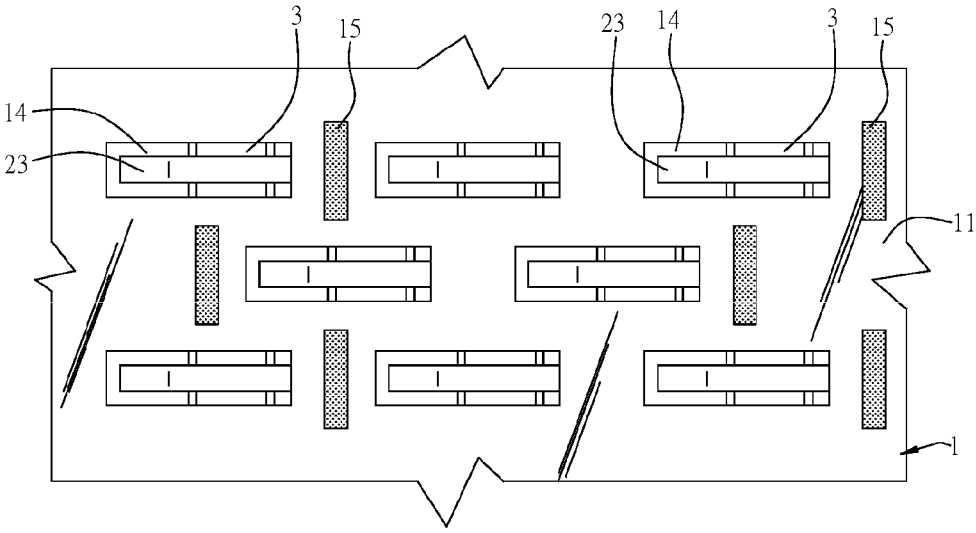
FIG. 8 is a top view of FIG. 7 when the chip module is removed.

Referring to FIG. 7 and FIG. 8, among the terminals 2, two neighboring terminals 2 form a pair for transmitting differential signal. In this embodiment, the number of pairs of terminals 2 for transmitting differential signal is multiple, while in other embodiments, the number may be one. When viewed from the top, a plurality of first conductive units 15 are distributed around the pair of terminals 2 for transmitting differential signal. When viewed from the bottom, a plurality of second conductive units 16 are distributed around the pair of terminals 2 for transmitting differential signal.

Figure 5:
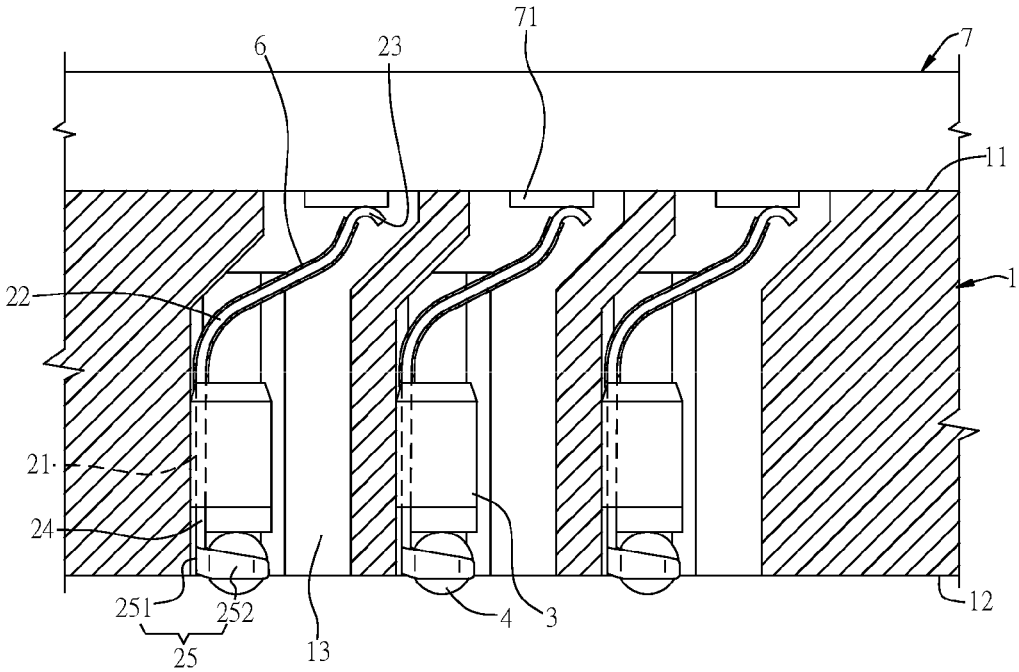
FIG. 5 is an assembled cross-sectional view of a shielded connector according to one embodiment of the present invention where a second insulating layer is disposed on a part of each terminal.

Referring to FIG. 5 and FIG. 6, the structure of each of the terminal 2 (except for the base 21) is suspended relative to the receiving hole 13. In other embodiments, terminals 2 may not be suspended. For example, a first insulating layer 5 is disposed on an inner wall of the receiving hole 13. Alternatively, a second insulating layer 6 is disposed on the structure of the terminal 2 except for the contact portion 23 and the soldering portion 25, and the second insulating layer 6 is used for isolating the terminal 2 from the conductive body 1 to prevent conduction between the two.

In this embodiment, the insulating member 3 is an insulating protrusion. The terminal 2 and the insulating member 3 are formed by insert molding, and the insulating member 3 is fixed to the conductive body 1 by interference fit. In other embodiments, the terminal 2 may be inserted into the insulating member 3 and the base 21 fixed in the insulating member 3, or the insulating member 3 may be a nonconductive layer disposed on a periphery of the base 21 or at the receiving hole 13. Through the above structure, the terminal 2 and the conductive body 1 are in a nonconductive state.

The solder ball 4 and the soldering portion 25 are fixed through clamping contact in this embodiment, and the solder ball 4 is located in the clamping space, but the present invention is not limited thereto, as long as the solder ball 4 can contact the soldering portion 25 and be in a nonconductive state with the conductive body 1.

During assembly, referring to FIG. 1, the shielded connector is used to electrically mount a chip module 7 onto a circuit board (not shown). A lower surface of the chip module 7 has a plurality of contact points 71 and a plurality of conducting points 72. In this embodiment, first, the terminals 2 and the insulating members 3 are formed by insert molding. Then, the insulating members 3 and the terminals 2 are disposed in the receiving holes 13 as a whole. Next, the solder balls 4 are disposed in the clamping space to form the shielded connector. Finally, the shielded connector is correspondingly placed on the circuit board (not shown), a reflow oven is used for heating and soldering to desirably fix the shielded connector to the circuit board (not shown) by soldering with the solder balls 4. Then the chip module 7 is mounted onto the shielded connector. The contact points 71 contact the contact portions 23 downward, and the supporting blocks 14 urge against the lower surface of the chip module 7.

In other embodiments, if the terminals 2 are inserted into the insulating members 3, the terminals 2 are inserted into the insulating member 3 first, and then the terminals 2 and the insulating member 3 are disposed in the receiving holes 13 together. Alternatively, the insulating members 3 are disposed in the receiving holes 13 first, and then the terminals 2 are inserted into the insulating members 3. If the insulating members 3 are a nonconductive layer, a nonconductive layer is disposed on the receiving hole 13 first, and then the terminal 2 is fixed in the receiving hole 13; alternatively, a nonconductive layer is disposed on a periphery of the base 21 first, and then the terminal 2 with the nonconductive layer is fixed in the receiving hole 13.

Referring to FIG. 7, when the shielded connector is conducted to the chip module 7 and the circuit board, the first conductive units 15 are conducted to the conducting points 72 of the chip module 7, and the second conductive units 16 are conducted to the circuit board, so that the first conductive units 15, the conductive body 1 and the second conductive units 16 are conducted to one another for transmitting ground signal.

Figure 4:
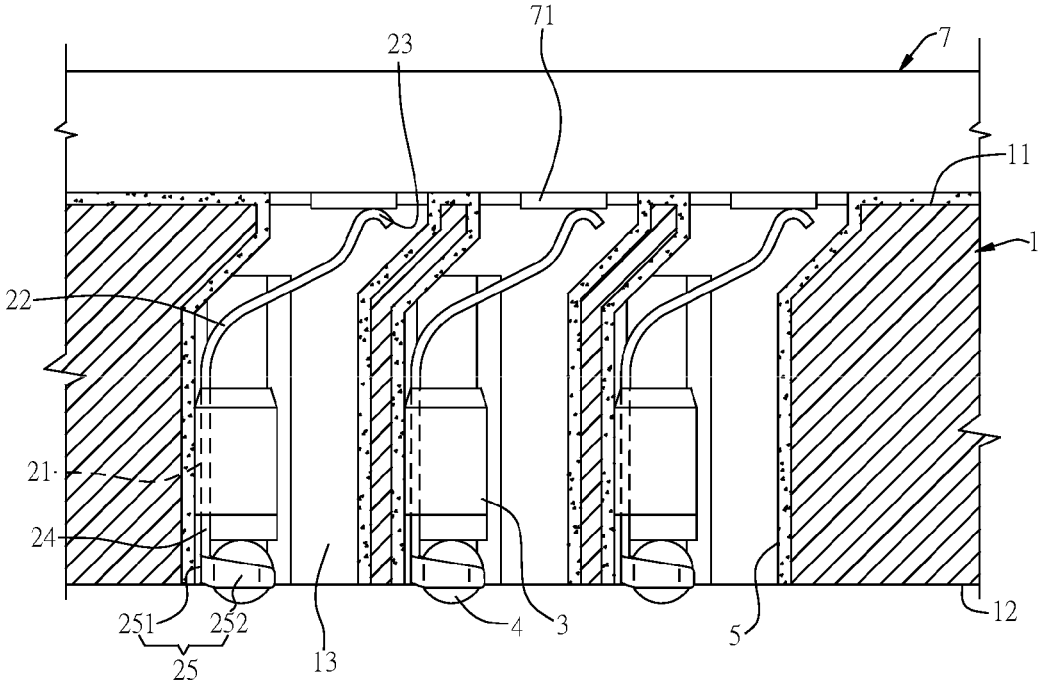
FIG. 4 is an assembled cross-sectional view of a shielded connector according to one embodiment of the present invention where a first insulating layer is disposed on an inner wall of each receiving hole.

Referring to FIG. 4, to prevent conduction between the terminals 2 and the conductive body 1, the first insulating layer 5 is used to isolate each of the terminal 2 from the conductive body 1. The first insulating layer 5 needs to be disposed before the terminal 2 is disposed in the receiving hole 13. That is, the first insulating layer 5 is disposed in the receiving hole 13, or alternatively, the second insulating layer 6 is disposed on the structure of the terminal 2 except for the contact portion 23 and the soldering portion 25.

Based on the above, the shielded connector of the present invention, among other thins, has the following beneficial effects.

1. The conductive body 1 is formed by integral injection molding, which, unlike the related art, does not require premolding an insulating body having a plurality of receiving holes and plating metal layers in the receiving holes, so that the process is simple yet novel and the problem in the related art that metal layers easily peel off is solved while ensuring a stable and good shielding effect.

2. To ensure that a mounting error of the terminal 2 does not result in conduction between the terminal 2 and the conductive body 1, the first insulating layer 5 is further disposed on the receiving hole 13 to prevent conduction between the terminal 2 and the conductive body 1. Or alternatively, the second insulating layer 6 may be coated on the extending arm 22 to prevent conduction between the terminal 2 and the conductive body 1.

3. When the chip module 7 is mounted on the shielded connector inaccurately, the contact points 71 are easily conducted with the conductive body 1. Therefore, by disposing the supporting blocks 14, the contact points 71 can be prevented from contacting the conductive body 1 to cause a short circuit.

4. As the first conductive unit 15 is conducted to the conducting point 72 of the chip module 7, and the second conductive unit 16 is conducted to the circuit board, the first conductive unit 15, the conductive body 1 and the second conductive unit 16 can be conducted to one another for transmitting ground signal.

5. When viewed from the top and from the bottom, a plurality of first conductive units 15 and a plurality of second conductive units 16 are distributed around the pair of terminals 2 for transmitting differential signal. As the first conductive unit 15, the conductive body 1 and the second conductive unit 16 can be conducted to one another for transmitting ground signal, a good shielding effect is achieved.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A shielded connector for electrically connecting a chip module to a circuit board, comprising:

a conductive body, having a plurality of receiving holes formed through the conductive body;

a plurality of insulating members, respectively fixed in the receiving holes; and a plurality of terminals, respectively fixed to the insulating members, wherein each terminal has a contact portion exposed upward to the insulating member and a soldering portion exposed downward to the insulating member, wherein each of the terminals has no direct contact with the conductive body.

2. The shielded connector according to claim 1, wherein the conductive body is made of a metal material.

3. The shielded connector according to claim 1, wherein the conductive body is made of a plastic material added with metal powders or a conductive material.

4. The shielded connector according to claim 1, wherein an insulating layer is disposed on an inner wall surface of each receiving hole.

5. The shielded connector according to claim 1, wherein each terminal has a base located in the insulating member, an extending arm extends upward from the base and is exposed upward to the insulating member, the contact portion extends from an end of the extending arm, a connecting portion extends downward from the base and is exposed downward to the insulating member, the connecting portion connects the base and the soldering portion, and insulating layers are plated on surfaces of the extending arm and the connecting portion.

6. The shielded connector according to claim 1, wherein the terminal and the insulating member are formed by insert molding.

7. The shielded connector according to claim 1, wherein each soldering portion comprises a baffle and a clamping arm respectively extending from two sides of the baffle, wherein the baffle and the clamping arms jointly define a clamping space, a plurality of solder balls are further disposed, and each solder ball is fixed in each clamping space.

8. The shielded connector according to claim 1, wherein a plurality of solder balls are further disposed, each solder ball is fixed to each soldering portion, and the solder ball and the conductive body are in an nonconductive state.

9. The shielded connector according to claim 1, wherein the insulating members are fixed to the conductive body by interference fit.

10. The shielded connector according to claim 1, wherein a plurality of supporting blocks are disposed on a top surface of the conductive body.

11. The shielded connector according to claim 1, wherein the conductive body has at least one elastic first conductive unit at least partially exposed upward to a top surface of the conductive body, and the conductive body has at least one second conductive unit at least partially exposed downward to a bottom surface of the conductive body.

12. The shielded connector according to claim 11, wherein the at least one first conductive unit and the at least one second conductive unit are made of a conductive sponge.

13. The shielded connector according to claim 11, wherein the at least one first conductive unit, the conductive body and the at least one second conductive unit are jointly used for transmitting ground signal.

14. The shielded connector according to claim 1, wherein at least two neighboring terminals among the terminals form a pair for transmitting differential signal.

15. The shielded connector according to claim 14, wherein a plurality of first conductive units and a plurality of second conductive units are distributed around the pair of terminals for transmitting differential signal.

* * * * *